US005975385A

United States Patent [19]

See

[11] Patent Number: 5,975,385

[45] Date of Patent: Nov. 2, 1999

[54] EXTENSIBLE CLOTHES HANGER

[76] Inventor: Benito L. See, 958 Stanford Street, Wack Wack Village, Mandaluyong City, Philippines

[21] Appl. No.: 09/151,817

[22] Filed: Sep. 14, 1998

[51] Int. Cl.[6] ..... A47G 25/44; A47G 25/14

[52] U.S. Cl. ..... 223/94; 223/DIG. 4

[58] Field of Search ..... 223/85, 89, 94, 223/92, DIG. 4; D6/324

[56] References Cited

U.S. PATENT DOCUMENTS

| | | | |
|---|---|---|---|
| 2,477,873 | 8/1949 | Hopkins et al. | 223/94 |
| 3,024,954 | 3/1962 | Michlin | 223/94 |
| 5,044,535 | 9/1991 | Hunt | 223/89 |
| 5,102,019 | 4/1992 | Lam | 223/94 |
| 5,201,443 | 4/1993 | Oswald | 223/94 |
| 5,456,391 | 10/1995 | Chang | 223/89 |
| 5,664,710 | 9/1997 | Lam | 223/94 |

*Primary Examiner*—Bibhu Mohanty

*Attorney, Agent, or Firm*—Steven Horowitz

[57] ABSTRACT

Adjustable hanger whose length conforms to the shoulder length of shirts, blouses, dresses, thereby eliminating unsightly stretch marks from fixed length hangers. The hanger's body contains a swiveling hook, a pinion, and right and left arms with built-in gear racks. A square-ended hook is held rotatably by its straight end in a cylindrical cavity in the central upper part of the body. A pinion with gear teeth is held rotatably by its head in another cylindrical cavity directly below the straight end of the hook. Pinion gear teeth engage the rack teeth of the left and right arms, which arms are radially shaped and are housed and guided in radial tracks in the body. By rotating the hook and simultaneously pushing it downwards into the body, the square end of the hook is made to enter the square hole of the pinion. Rotating the hook at this point will rotate the pinion whose teeth will pull the left and right arms to move radially in the tracks of the body. Rotating the hook in one direction may simultaneously move the left and right arm to extend out of the body to lengthen the hanger. Rotating the hook in the opposite direction may simultaneously move the left and right arms to retract into the body to shorten the hanger.

2 Claims, 6 Drawing Sheets

EXTENSIBLE CLOTHES HANGER

The present invention relates generally to garments and clothes hangers used to hang clothes for storage and for display.

It is more closely related to the hangers found in most households and stores that are of triangular shaped body with a hook at the upper vertex. They come in various sizes of fixed lengths.

There is a disadvantage in using this type of hanger on shirts and blouses when the length of the hanger does not match the shoulder length of the garment. If the hanger length is too short, stretch marks may appear on the shoulder part of the garment. If it is too long, stretch marks may appear on the sleeves. It is difficult to exactly match the length of the hanger to the garment because the shoulder lengths of garments are not standardized. Each garment brand differs from the others in physical dimensions though they may belong to the same category, namely, small, medium, large and extra large.

The appearance of stretch marks depends on the material of the fabric, the weight of the garment and the length of time it is subjected to hanging. Usually the more expensive garments are hung for longer periods of time since they are used only for special occasions. Therefore, the most expensive clothes are more likely to develop stretch marks through the use of incorrect length of hangers.

The object of the present invention is to provide a hanger with adjustable length to conform exactly to the shoulder length of any shirt, blouse or dress, thereby eliminating the problem of unsightly stretch marks.

BRIEF DESCRIPTION OF THE DRAWINGS

This and other objects will be fully appreciated upon reading the following descriptions of the accompanying drawings.

DETAILED DESCRIPTION OF THE DRAWINGS

Figure 1:
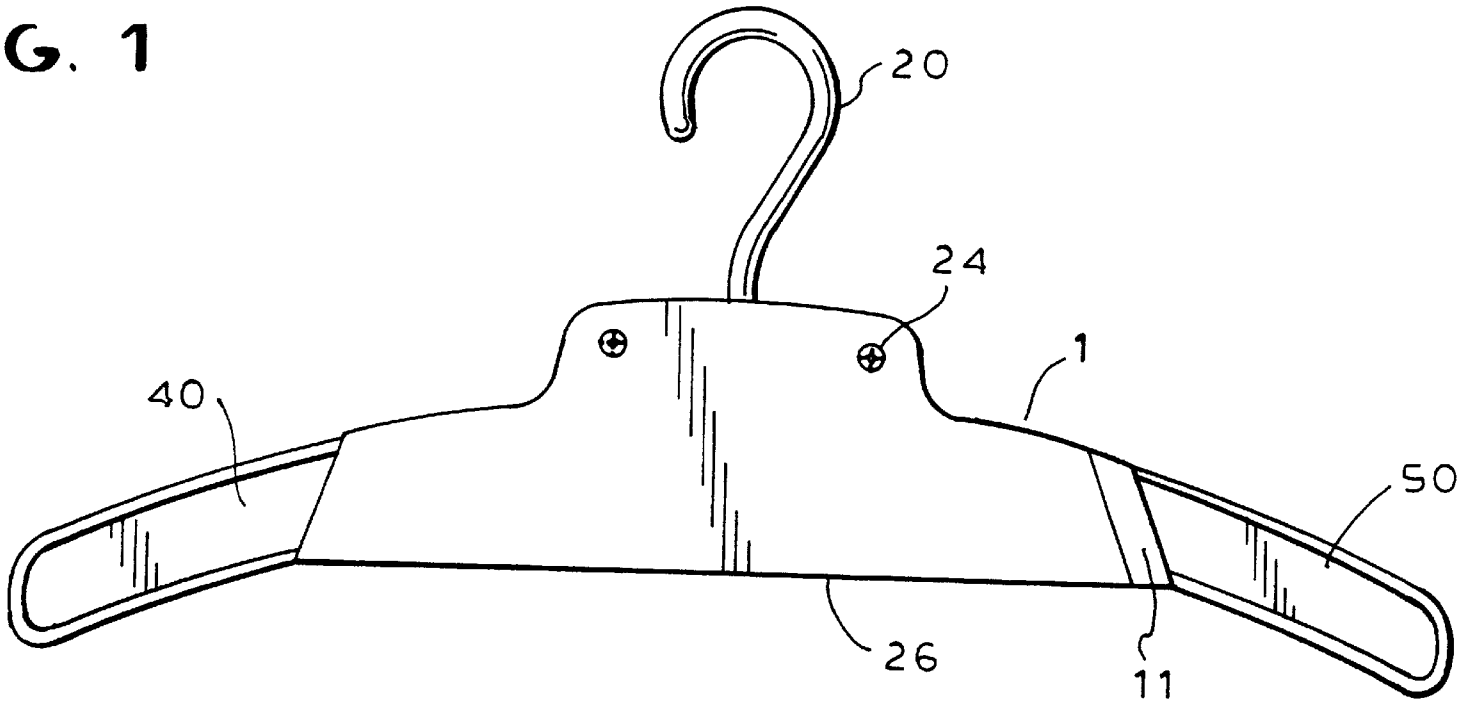
FIG. 1 is a front view of the assembled hanger of the present invention.

Extendible hanger 80 consists of five parts: the body 1, the right arm 50 with rack or rack teeth 54, the left arm 40 with rack teeth 44, the pinion 30 and the hook 20. These five parts may be made of polymer plastic and injection molded.

Figure 1A:
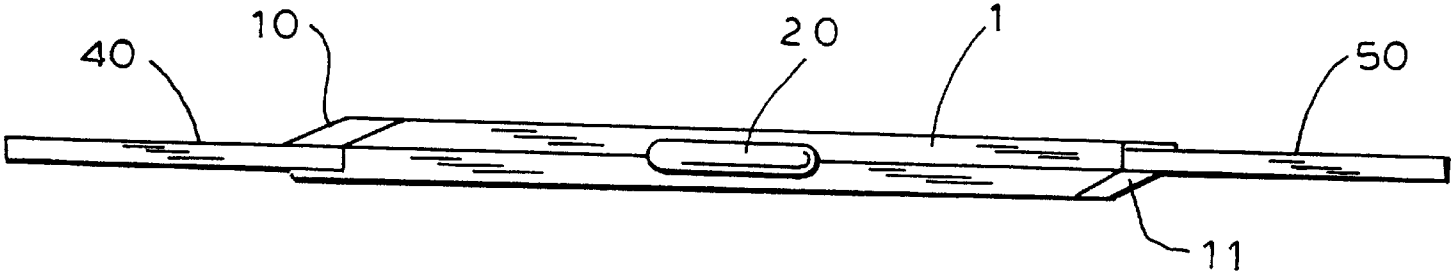
FIG. 1A is a top view of the assembled hanger of the present invention.
Figure 2:
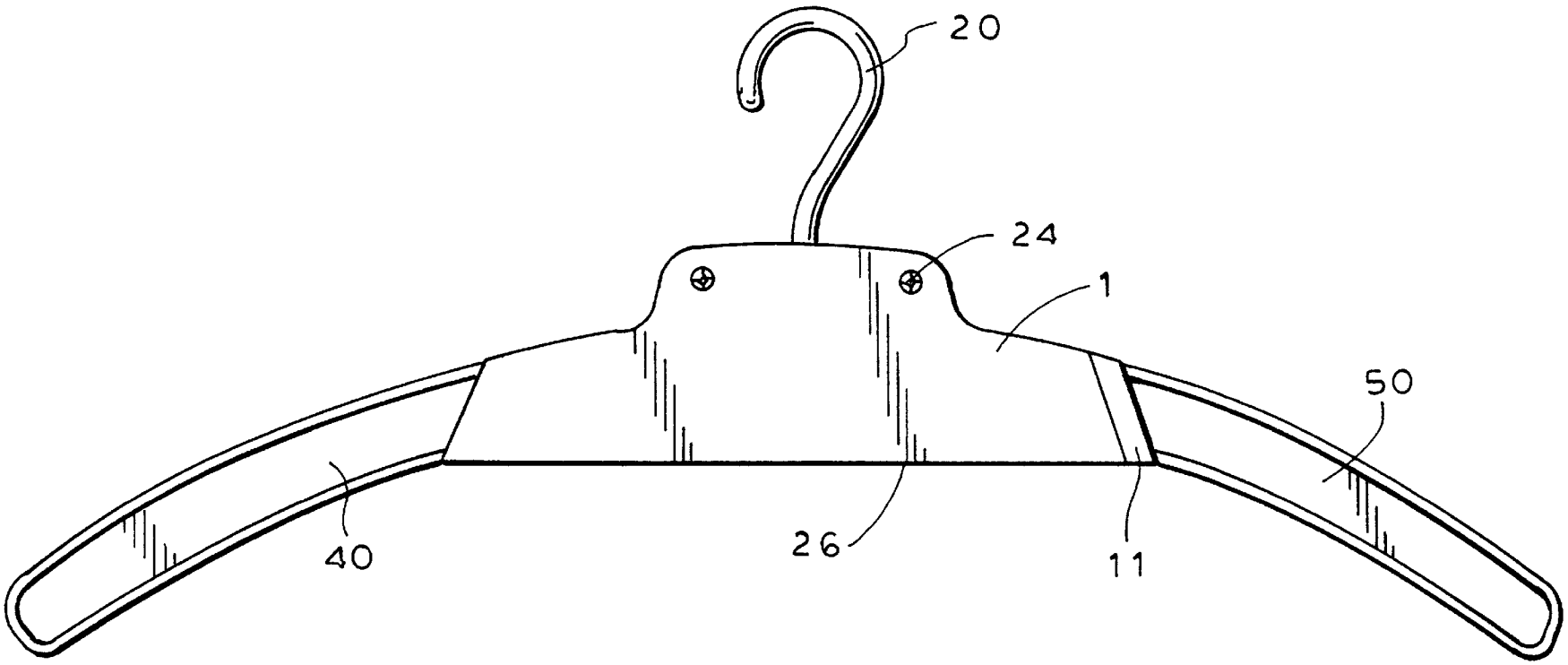
FIG. 2 is a front view of the assembled hanger with its arms fully extended.

Referring to the drawings, FIGS. 1 and 1A show the hanger body 1 housing a left arm 40 and a right arm 50 that are slidably fitted in body 1 and a hook 20 that can be pulled up, pushed down and rotated in body 1. In the pushed down position, the rotation of the hook 20 actuates the left arm 40 and the right arm 50 to simultaneously extend out of the body 1 to make the length of hanger 80 longer, as shown in FIG. 2, or to simultaneously retract the arms 40, 50 into body 1 to make the hanger 80 shorter, as shown in FIG. 1.

Figure 3:
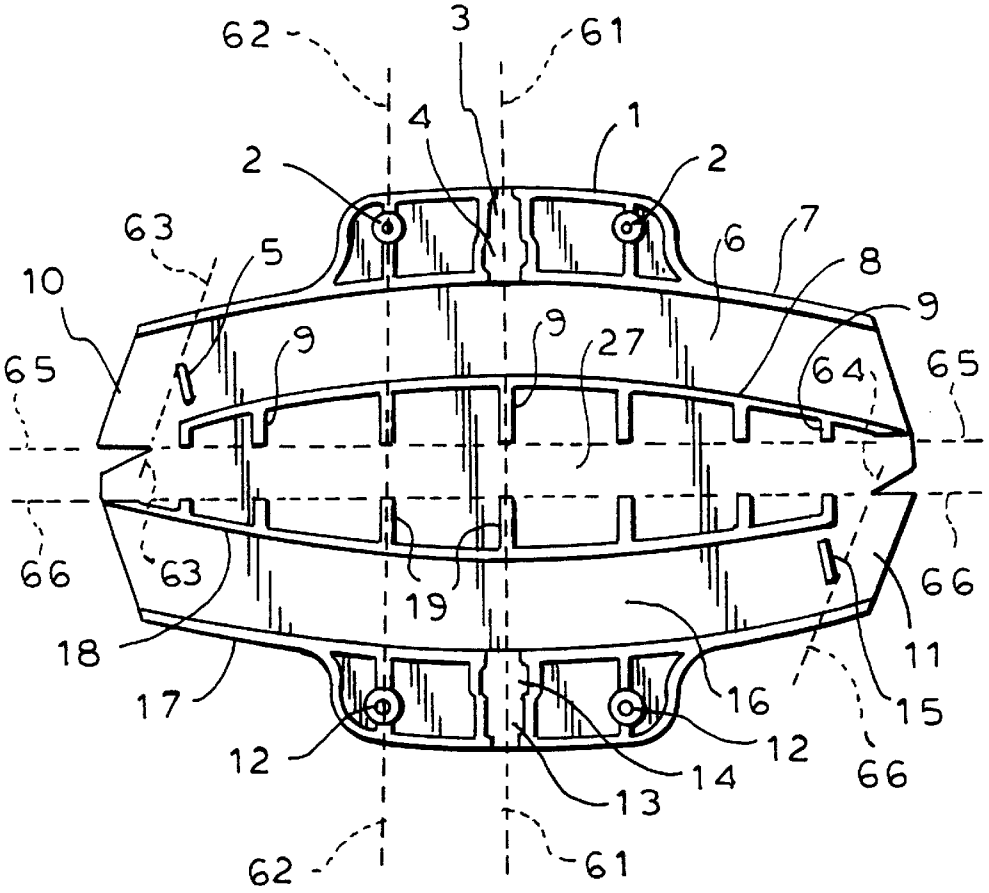
FIG. 3 is an front view of the body of the hanger of the present invention in an open or unfolded position.
Figure 3A:
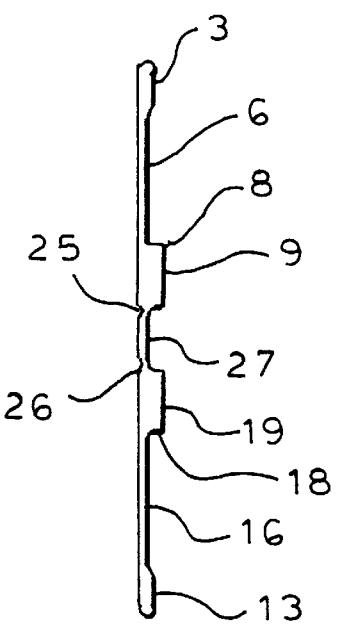
FIG. 3A is a cross-sectional view of the body of the hanger taken along line 61—61 of FIG. 3.
Figure 3B:
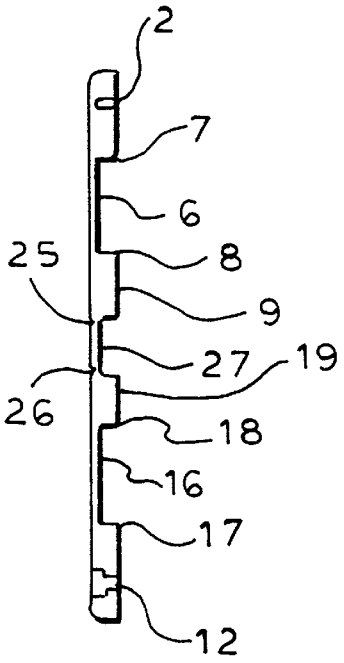
FIG. 3B is a cross-sectional view of the body of the hanger taken along line 62—62 of FIG. 3.

The hanger body 1 can be made of a semi-flexible plastic such as polypropylene and injection molded in its "open" or unfolded position, as seen in FIGS. 3, 3A and 3B. This "open" position reveals two halves of body 1 that have identical features except for the screw holes 2, 12. Cylindrical depressions 3, 4 of the upper half of body 1 are identical with the cylindrical deprssions 13, 14 of the lower half respectively. The body track 6, guide 7 and guide 8 of the upper half of body 1 are also identical with the track 16, guide 17 and guide 18 of the lower half respectively.

The lower half of the body 1 can be folded up to be perpendicular to the middle part 27 of body 1 at the thin indented section 26 along line 66—66. The upper half of body 1 can also be folded up to be perpendicular to the middle part 27 of body 1 at the thin indented section 25 along line 65—65. In this position the two halves of the body 1 are parallel and guides 7, 8 and braces 9 are aligned and adjacent with guides 17, 18 and braces 19 respectively to form a "closed" position of body 1, as shown in FIGS. 1 and 2. Depressions 3 and 4 of the upper half align with depressions 13 and 14 of the lower half respectively and together form respective perfect cylindrical cavities. Screw holes 2, 12 are also aligned and self-tapping screws 24 enter through holes 12 and thread on to holes 2 to keep body 1 from unfolding.

Figure 4:
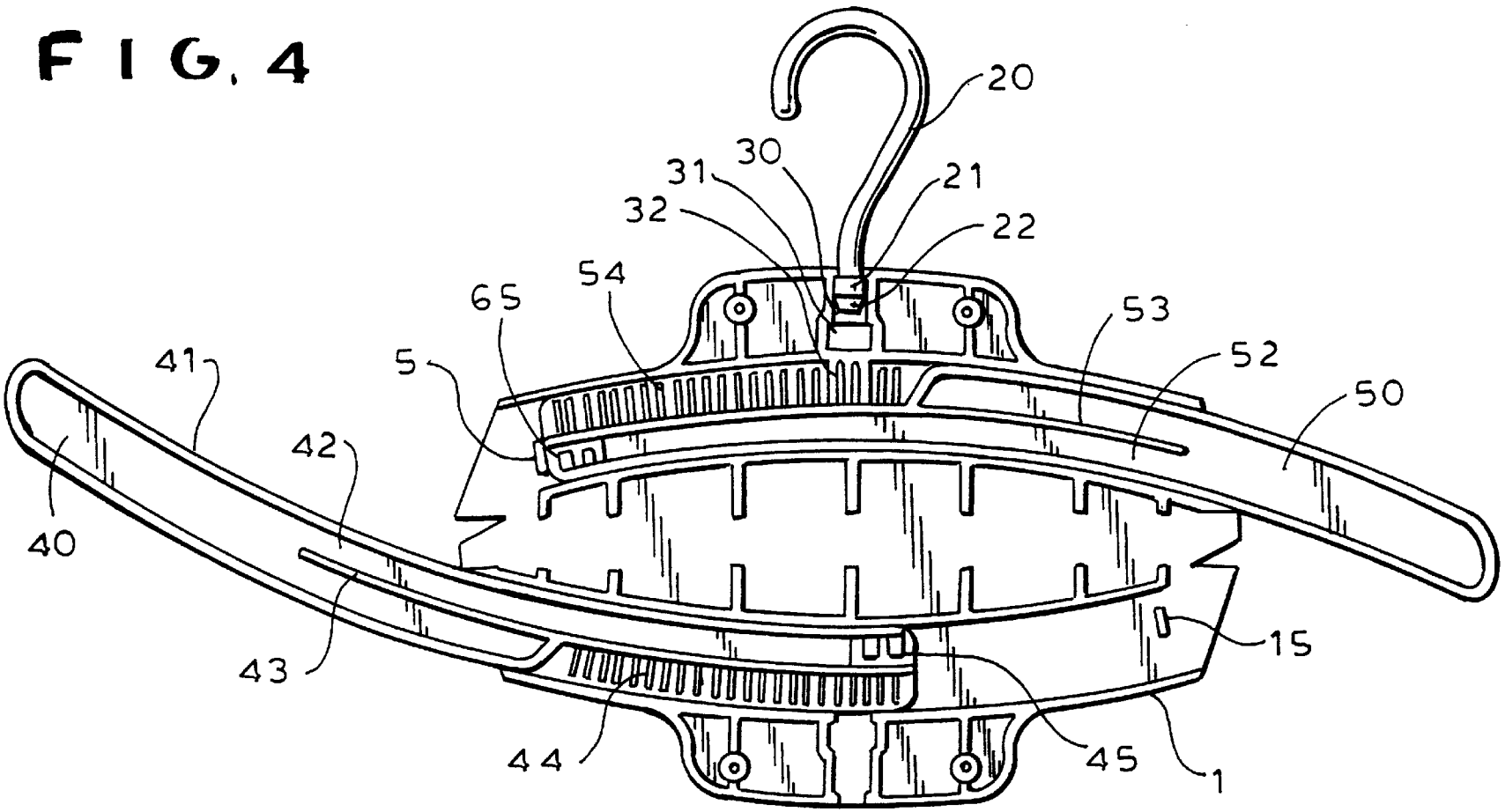
FIG. 4 is a front view of the body of the hanger of the present invention in an open or unfolded position and including the hanger arms, hook and pinion.

Referring now to FIGS. 3 and 4, the cylindrical depressions 3 and 13 of body 1 house and retain rotatably the straight end 21 of hook 20. The cylindrical depressions 4, 14 of body 1 house and retain rotatably the head 31 of pinion 30. Pinion teeth 32 extend down to the body track 6 and engage the rack teeth 54 of the right arm 50. The pinion teeth 32 also engage the rack teeth 44 of the left arm 40 when the body 1 is folded up in the "closed" position.

Referring to FIGS. 3, 3A and 3B, the body tracks 6, 16 are of the same radial configuration and are respectively bounded by guides 7, 8 in the upper half of body 1 and by guides 17, 18 in the lower half. The body track 6 houses right arm 50 slidably while track 16 houses left arm 40 slidably in the radial direction. Several braces 9, 19 support and strengthen guides 8, 18 respectively. Body stoppers 5, 15 in the body tracks 6 and 16 respectively limit the movement of arms 40, 50 during retraction. As shown in FIG. 4, right arm 50 is fully retracted with its end touching body stopper 5.

Two narrow and thin indented sections 25, 26 are incorporated into body 1 and run the whole length from one end of body 1 to the other end of body 1 along lines 65—65 and 66—66 respectively. These two sections 25, 26 enable body 1 to be folded up easily and accurately align all the features of the upper half of the body 1 with those of the lower half.

The end sections 10, 11 respectively of body 1 are inclined at an angle towards the ends of the body 1 beginning at lines 63—63 and 64—64 respectively. The inclined sections 10, 11 at both ends of body 1 are shown clearly at the top view of the "closed" hanger in FIG. 1A. Because of these inclined sections 10, 11, triangular-shaped cut-outs are needed besides these sections at both ends of body 1 to allow the two halves to be folded up.

The different views and cross-sectional details of right arm 50 are shown in FIGS. 5, 5A, 5B and 5C. Left arm 40 is exactly identical to right arm 50 in all respects. The radii at 56 and 57 of right arm 50 correspond exactly to the radii of the guides 7 and 8 respectively. The radii at 46 and 47 of left arm 40 also correspond exactly to the radii of the guides 17 and 18 respectively. Rack teeth 54 are rigidly supported in two planes and are built at one end of the right arm 50.

Figure 5:
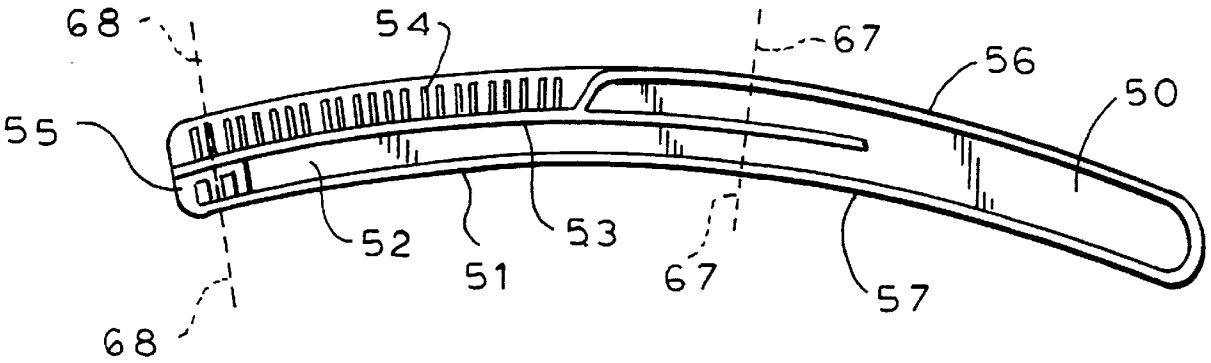
FIG. 5 is a front view of the right arm of the hanger.
Figure 5A:
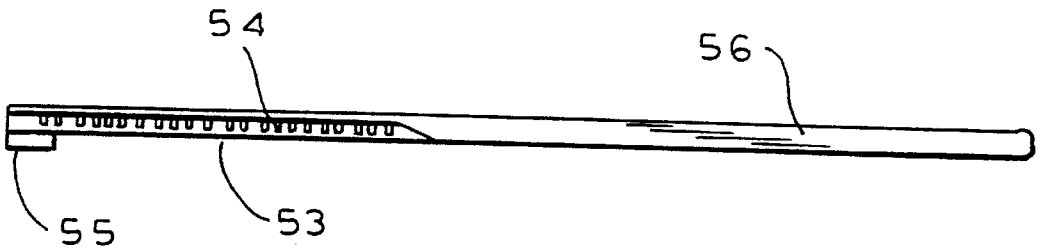
FIG. 5A is a top view of the right arm of the hanger.
Figure 5B:
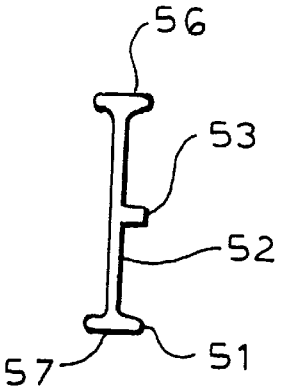
FIG. 5B is a cross-sectional view of the right arm taken along line 67—67 of FIG. 5.
Figure 5C:
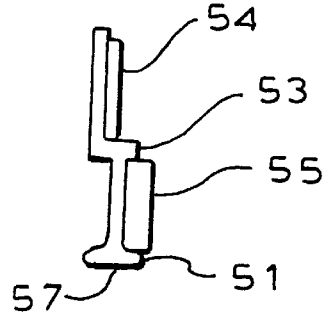
FIG. 5C is a cross-sectional view of the right arm taken along line 68—68 of FIG. 5.

Arm stopper 55 protrudes from the side of arm 50 below rack teeth 54 at one end as shown in FIGS. SA and 5C. Arm stopper 55 fits slidably into arm track 42 of the left arm 40 which is identical to the arm track 52 of right arm 50, as shown in FIG. 5B Arm track 52 is bounded on the sides by guides 51, 53. In the hanger's 80 assembled state, right arm stopper 55 fits slidably into left arm track 42 while left arm stopper 45 fits slidably into right arm track 52. When the arms 40, 50 are fully extended, arm stoppers 45, 55 touch each other and prevent further extension of arms 40, 50.

In addition, arm stoppers 45, 55 impart more strength and durability to hanger 80. With stoppers 45, 55 interconnected to each other's arm tracks 42, 52, arms 40, 50 function as single unit. When the hanger 80 is loaded with a garment, a significant portion of the garment's weight bears down on the extended parts of arms 40, 50. Since the two arms 40, 50 function as a single unit, the weight on arms 40, 50 is uniformly distributed along the whole radial length of guides 8, 18 of body 1. There is no concentration of forces on any part of body 1 that can cause deformation due to creep under prolonged application.

Figure 6:
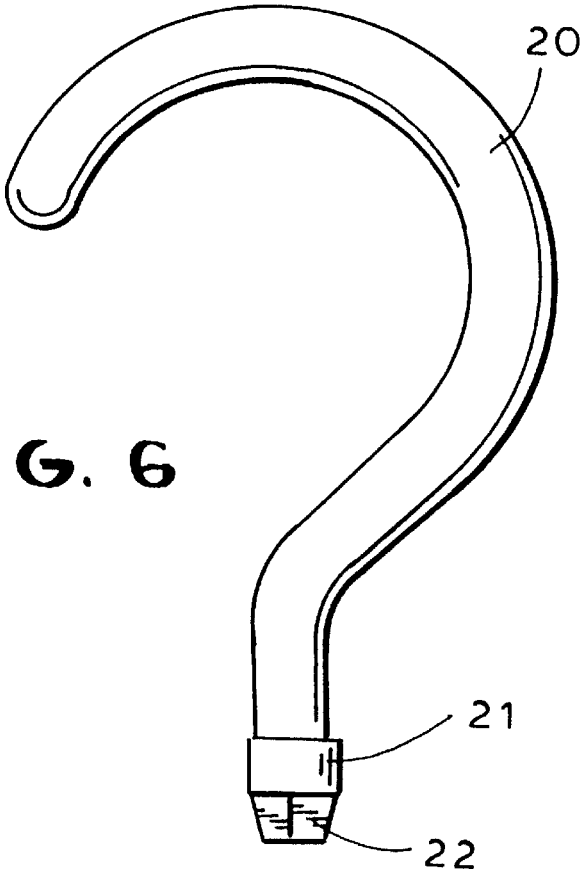
FIG. 6 is a front view of the hook of the hanger.
Figure 6A:
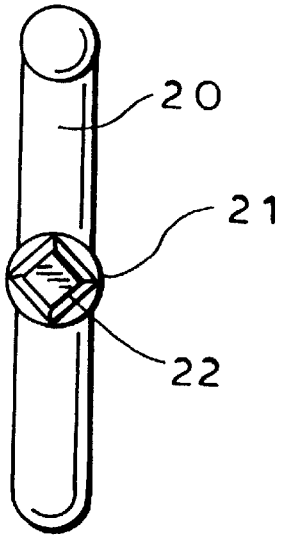
FIG. 6A is a bottom view of the hook of the hanger.
Figure 7:
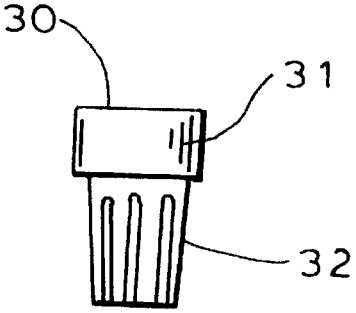
FIG. 7 is a front view of the pinion of the hanger.
Figure 7A:
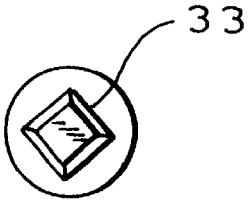
FIG. 7A is a top view of the pinion of the hanger.

FIGS. 6 and 6A show the details of hook 20 including the straight cylindrical end 21 that fits rotatably into the cylindrical depressions 3, 13 of body 1. The four sides of the square end 22 are tapered at an angle to make it easier to enter and exit to and from the square hole 33 of pinion 30. The four sides of the square hole 33 of the pinion 30 are tapered to the same angle to achieve a perfect fit with square end 22 of hook 20. FIG. 7 shows the pinion teeth 32 that engage the rack teeth 44, 54 of arms 40, 50.

To summarize the operation of the extendible hanger: when the hook 20 is pulled up with respect to body 1 the square end 22 of the hook 20 is out and clear of pinion head 31 and is free to swivel. When hook 20 is pushed down into body 1 and simultaneously rotated, square end 22 of hook 20 will enter into square hole 33 of pinion 30 thereby engaging hook 20 to pinion 30. Further rotation of hook 20 at this point will cause pinion 30 to rotate and its gear teeth 32 to push against the rack teeth 44, 54 of arms 40, 50 respectively. The force acting on rack teeth 44, 54 of arms 40, 50 will move the arms 40, 50 radially along body tracks 6, 16. Rotating the hook 20 in one direction may simultaneously extend arms 40, 50 out of body 1, thus increasing the length of hanger 80. Rotating hook 20 in the opposite direction may simultaneously retract arms 40, 50 into body 1 to shorten the length of hanger 80.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A clothes hanger of adjustable length capable of conforming to the length of any garment, comprising:

a body having built-in cylindrical depressions and radial tracks, the body containing a hook, a pinion and extendible radial right and left arms that can be actuated by means of rack and pinion, said hook and pinion being held rotatably in respective cavities in the body, said extendible radial right and left arms being guided in their movement by the radial tracks in the body and having built-in rack teeth that engage teeth of the pinion, wherein the right and left arms have arm tracks and have built-in protruding stoppers at one end that fit into each other's arm tracks to make the right and left arms function as a single unit, and wherein the extension and retraction of the right and left arms is actuated by the rotation of the hook when the hook is engaged with the pinion.

2. A clothes hanger of adjustable length capable of conforming to the length of any garment, comprising:

a body having built-in cylindrical depressions and radial tracks, the body containing a hook a pinion and extendible radial right and left arms that can be actuated by means of rack and pinion, said hook and pinion being held rotatable in respective cavities in the body, said extendible radial right and left arms being guided in their movement by the radial tracks in the body and having built-in rack teeth that engage teeth of the pinion, wherein the right and left arms have arm tracks and have built-in protruding stoppers at one end that fit into each other's arm tracks to make the right and left arms function as a single unit, and wherein the extension and retraction of the arms is actuated by the rotation of the hook when the hook is engaged with the pinion, a square end of the hook being made to engage the pinion by rotating and pushing the hook down into the body and the hook being made to disengage from the pinion and being free to swivel by pulling up the hook from the body.

* * * * *